US005966885A

United States Patent [19]

Chatelain

[11] Patent Number: 5,966,885

[45] Date of Patent: Oct. 19, 1999

[54] FOAM PANELS FOR WALL CONSTRUCTION

[76] Inventor: Paul J. Chatelain, 16009 Amber Valley, Whittier, Calif. 90604

[21] Appl. No.: 08/980,570

[22] Filed: Dec. 1, 1997

[51] Int. Cl.[6] ..... E04C 1/00

[52] U.S. Cl. ..... 52/309.4; 52/309.7; 52/745.09

[58] Field of Search ..... 52/309.4, 309.7, 52/309.12, 309.17, 800.1, 800.12, 745.09; 256/31, 73, 24, 19

[56] References Cited

U.S. PATENT DOCUMENTS

| | | | |
|---|---|---|---|
| 4,303,722 | 12/1981 | Pilgrim | 428/213 |
| 4,364,790 | 12/1982 | Delcoigne et al. . | |
| 4,488,917 | 12/1984 | Porter et al. . | |
| 4,566,558 | 1/1986 | Link et al. | 181/210 |
| 4,578,915 | 4/1986 | Schneller | 52/309.12 |
| 4,674,593 | 6/1987 | McCarty | 181/210 |
| 4,774,794 | 10/1988 | Grieb | 52/309.7 |
| 4,899,498 | 2/1990 | Grieb | 52/144 |
| 4,961,298 | 10/1990 | Nogradi | 52/235 |
| 5,129,628 | 7/1992 | Vesper | 256/31 |
| 5,404,685 | 4/1995 | Collins | 52/309.7 |
| 5,722,198 | 3/1998 | Bader | 52/800.12 X |

*Primary Examiner*—Beth Aubrey
*Attorney, Agent, or Firm*—Edgar W. Averill, Jr.

[57] ABSTRACT

A panel for use in the construction of walls. The panel is preferably about 2' high and 10' long with a thickness of approximately 4". An upper pair of grooves is formed longitudinally near the top and another pair formed longitudinally near the bottom. A metal C-shaped reinforcing member is held by these grooves over the top and bottom of the rectangular panel to reinforce the same. Preferably the top and bottom are slightly beveled so that when one panel is placed with its top adjacent the bottom of a superior panel, a slight depression is formed which may be readily filled with a grout to provide a smooth upper surface. The panel is particularly useful in conjunction with spaced fence posts which have grooves to permit the panel to be slid in between two adjacent posts. After grouting, the entire fence or wall may be stuccoed to give it a smooth and attractive appearance.

13 Claims, 5 Drawing Sheets

14
11
10
16
12
15
13

11
16
15
13

22
24
17
23
10 a
25
24
26
27
28
21
21
18
17
18
19
20
12

22
30
23
10

22
18
17

FIG.11.
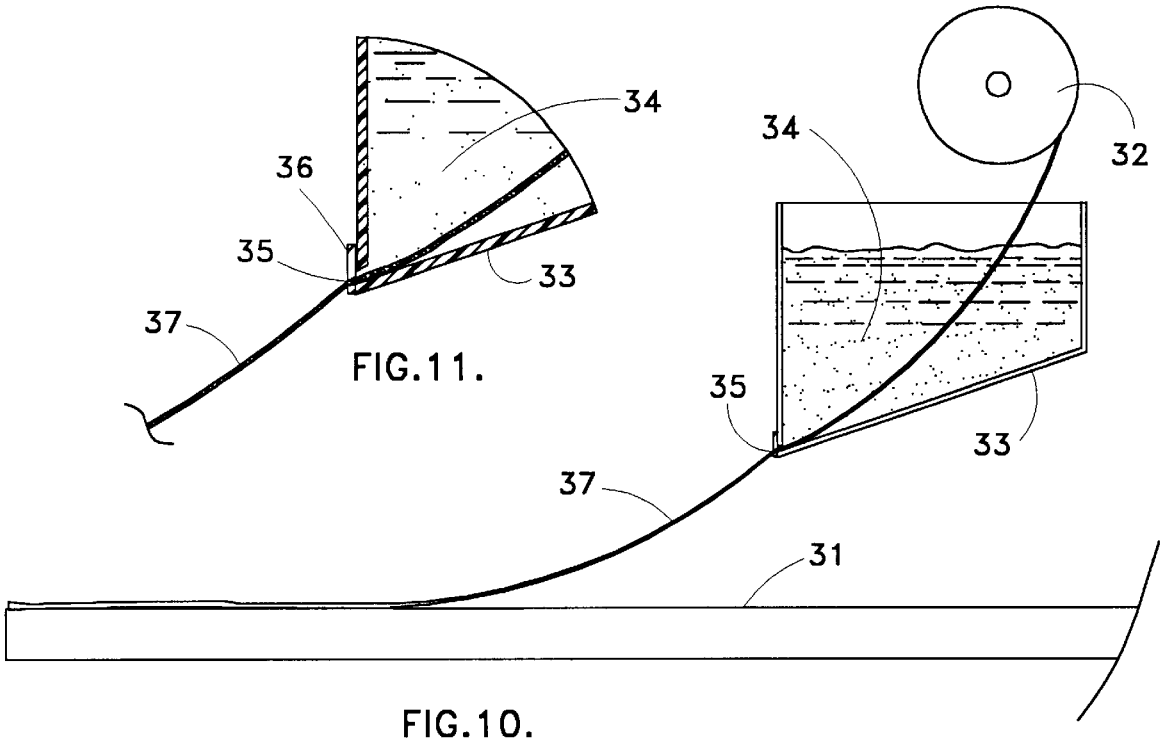
FIG.10.
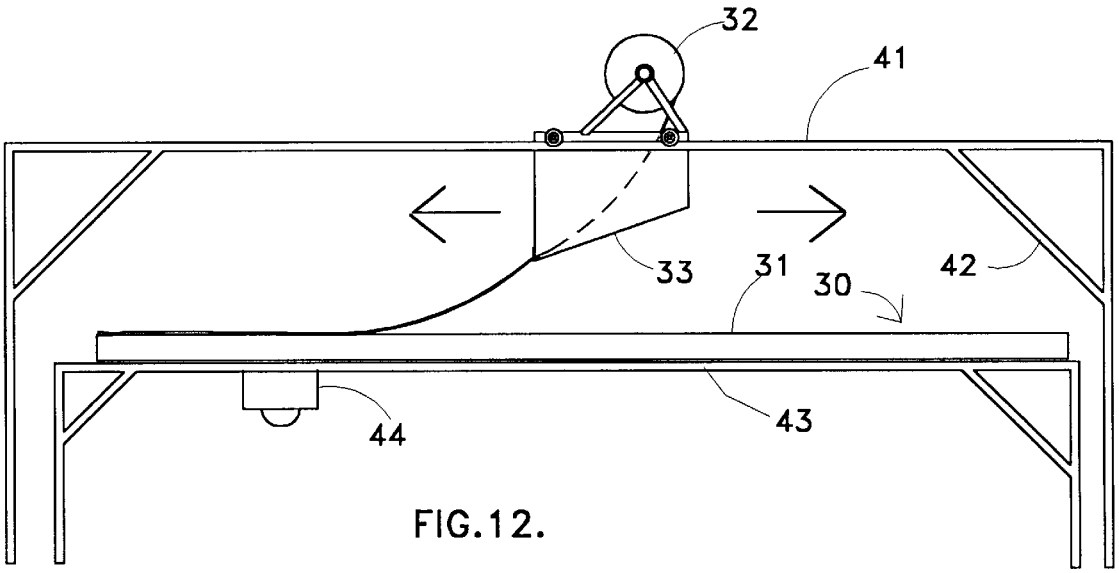
FIG.12.

FOAM PANELS FOR WALL CONSTRUCTION

BACKGROUND OF THE INVENTION

The field of the invention is building materials and the invention relates more particularly to the building of walls or fences. Perhaps the most common wall is built from cement block which requires a substantial foundation to be dug below the wall and filled with concrete to support the weight of the cement blocks. The cement blocks must be placed by a professional mason or a skilled amateur to provide a wall that has an attractive appearance. In spite of the use of foundations, such walls frequently settle in parts and form a "stairstep" crack along the joints between adjacent blocks. Such block walls are commonly covered with a layer of stucco and this crack is visible on the exterior of the stucco. This is an especially common problem with clay soils which tend to expand when wet and contract when dried.

Other common types of fences include grape stake fences or fences made with vertical slats which are nailed to rails. Unfortunately, wood has become a scarcer and more expensive commodity. Whereas original growth redwood had excellent weathering characteristics, newer redwood does not have this same ability. Thus, when such fences are built utilizing wooden posts, such posts rather quickly rot or are eaten by termites and need to be replaced in less than 10 years. Chain link fences are very widely used but have an industrial look which is unacceptable for most residential or office developments.

Various approaches have been taken to provide walls which overcome some of the problems mentioned above. The present invention also contemplates an efficient process for coating the exterior surfaces of a foam panel and various approaches have been taken for such coating processes. For instance, U.S. Pat. No. 4,303,722 shows a process for adhering glass fibre tissue to a panel. This is accomplished by passing a tissue through a pair of rollers which impregnate the tissue with adhesive. A moving belt of release material is used to press the adhesive coated tissue onto the surfaces of the foam.

A process for making plasterboard is shown in U.S. Pat. No. 4,364,790 where a roll of reinforcing material such as paper, cardboard, metallic film, aluminum sheet, glass, cloth, etc. is placed within a layer of plaster by various methods to form a reinforced plasterboard. In U.S. Pat. No. 4,488,917, cement board is made by spreading mortar over fiber scrim in a continuous manner.

Various wall constructions are disclosed in the prior art. A noise barrier is shown in U.S. Pat. No. 4,566,558. Posts made of channel material hold panels 12. The panels include a foam portion into which various channels are embedded. The foam is covered with plastic facing and chambers are provided to hold a sound absorption material.

A wall utilizing a polystyrene bead board core having a thin concrete facing reinforced with a fiberglass open weave mesh is shown in U.S. Pat. No. 4,578,915. Vertical steel studs hold gypsum wallboard 14 on an inner surface. On the outer surface, foam panels have been coated with a fiberglass mesh which contains a thin fiberglass mesh. After the panels have been screwed to the steel studs, the joints are taped and the entire assembly is coated with a Portland Cement exterior coating.

A sound barrier fence is shown in U.S. Pat. No. 4,674,593. This sound barrier uses concrete posts which are formed with grooves. Cement panels are placed in the grooves and the space between the cement panels is filled with a foam.

U.S. Pat. No. 4,899,498 is another highway sound barrier. The wall panels are made from a foamed material which is covered with a fiberglass reinforced cement composition. The panels are anchored to the ground by a helical screw anchor rod embedded in a concrete pad. U.S. Pat. No. 4,961,298 shows a prefabricated exterior panel system which also uses a plastic foam board reinforced along one surface by spaced-apart reinforcing members, such as aluminum channels. Grooves are cut into the panel and the reinforcing members are held in the grooves by an adhesive.

U.S. Pat. No. 5,129,628 shows a fence wall construction which has reinforcing flanges concealed within the plastic foam body. Lastly, U.S. Pat. No. 5,404,685 shows a foam plastic wall covered with an exterior mesh stucco coating. The panels are held in grooves in adjacent posts. The styrofoam panels are coated after they have been placed between adjacent posts.

Numerous approaches have been tried to make walls out of foam panels covered with reinforced cement. Such approaches have the advantage of a lightweight panel which nonetheless has an exterior coating which is not only strong but is fire and insect proof. The foam panels themselves are relatively weak and can be easily bent. They, thus, must be supported by some sort of substrate before being coated with a reinforced cementitious material. The coating process requires skill and, thus, the form on the jobsite must be done by skilled labor.

BRIEF SUMMARY OF THE INVENTION

It is an object of the present invention to provide a panel which may be made at a manufacturing location so that it is straight and coated with a reinforced cementitious type of coating when it is purchased by the end user. It is another object of the present invention to provide a set of panels which may be combined and attached together in such a way that the finished wall or fence is easily made smooth.

It is a further object of the present invention to provide a process for fabricating a panel with structural strength which may be easily used by inexperienced persons to build a wall with a highly professional appearance.

The present invention is for a panel for use in the construction of walls. The panel has a generally rectangular core which is made from a polymeric foam. The foam panel is elongated. A typical panel having a height of 2' and a length of 10' so that it may be easily carried by the end user. The panel has a pair of grooves formed in the faces adjacent the top and at bottom edges and a metal C-shaped reinforcing channel is held in these grooves along the top and bottom edges of the foam panel to hold the panel in a straight configuration. Preferably, the top and bottom edges of the panel are beveled so that when one panel is placed on top of another panel, a shallow trough is formed which may be later easily filled to form a smooth surface.

The process for forming the panel of the present invention includes passing a woven mesh of reinforcing fiberglass through a cementitious tub. This fills the pores in the mesh with the cementitious material which is then pulled out of the bottom of the tub through a measured slit, thereby causing the mesh to carry the cementitious material in its interstices. The cement laden mesh is then placed along the upper surface of a panel. The panel is then vibrated to remove any air and smooth out the upper surface of the cementitious material capturing the reinforcing mesh which is then allowed to cure on the upper surface of the panel.

The process for building a smooth surface panel fence includes the steps of placing vertical fence posts in the ground spaced apart a distance no longer than that of the length of the panels used to build the fence. The posts are provided with channels into which the panels may be slid. After the panels have been slid into the posts, a shallow trough is formed at the intersection of adjacent panels which is then filled with a reinforced cementitious material to provide a smooth surface. Lastly, the entire fence is covered with a stucco-like coating to provide a smooth fence which does not require any continuous footing.

BRIEF DESCRIPTION OF THE DRAWINGS

FIG. 10 is a side view partly in cross-section of the coating process of FIG. 8 showing the interior of the coating tank.

FIG. 11 is an enlarged cross-sectional view of the portion of the tank and mesh of FIG. 10.

FIG. 12 is a side view showing the frame which holds the panel and coating apparatus of FIG. 10.

DESCRIPTION OF THE PREFERRED EMBODIMENTS

Figures 1, 2, 3, 4, 5, 6:
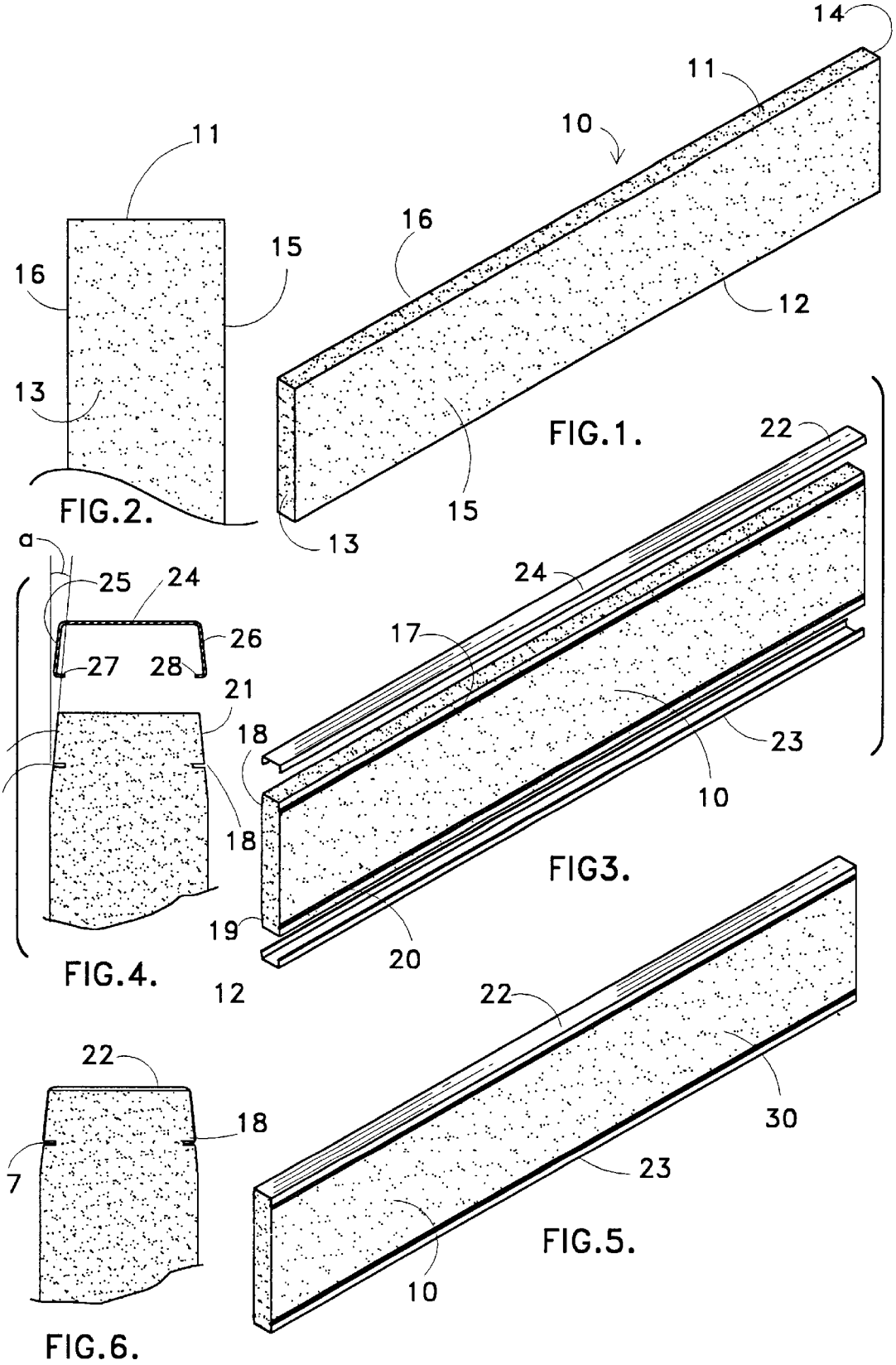
FIG. 1 is a perspective view showing a foam panel.
FIG. 2 is an enlarged end view of the panel of FIG. 1.
FIG. 3 is a perspective view of the panel of FIG. 1 modified by adding grooves by beveling the top edges and showing a pair of reinforcing channels above and below the panel.
FIG. 4 is an enlarged end view of the panel and reinforcing channel of FIG. 3.
FIG. 5 is a perspective view of the panel of FIG. 3, except that the channels have been attached into the grooves of the panel.
FIG. 6 is an enlarged end view of the top of the panel of FIG. 5.

A styrofoam panel is shown in perspective view in FIG. 1 and indicated generally by reference character 10. Panel 10 has a top 11, a bottom 12, a first end 13, a second end 14, a first face 15, and a second face 16. The panel is preferably about 2' high, 10' long and 3⅝" thick. Needless to say, the panel is very light and can be easily lifted by one person. The top corner of panel 10 is shown in FIG. 2 prior to any shaping steps.

Panel 10 is shown in a shaped configuration in FIG. 3. As shown best in FIG. 4, panel 10 has a pair of grooves 17 and 18 formed near top 11. A similar pair of grooves 19 and 20 are formed near bottom 12. A shallow beveled portion is formed on both sides adjacent top 11 and bottom 12 and indicated by reference character 21. This bevel can be of a relatively small angle, such as 5°, and the angle is indicated by the reference character "a" in FIG. 4. This angle forms an important part of the present invention and permits adjacent panels to be joined in a smooth and attractive manner as described below.

Another important feature of the present invention is the pair of reinforcing channels 22 and 23. Each channel has a flat face 24, two generally flat sides 25 and 26, and a pair of inwardly depending portions 27 and 28. Channels 22 and 23 should be formed from a material of sufficient strength to hold the somewhat flexible foam panel 10 in a straight configuration. One material that has been found sufficient for this purpose is 25 gauge galvanized iron sheet bent into the shape shown in FIGS. 3 and 4. Other strong materials, such as glass reinforced nylon or other composite materials can, of course, be used. The important feature is a separate piece which may be snapped over or slid onto the top and bottom of the foam panel and held in a straight configuration.

The assembled uncoated panel is shown in FIGS. 5 and 6 and indicated by reference character 30.

Figure 7:
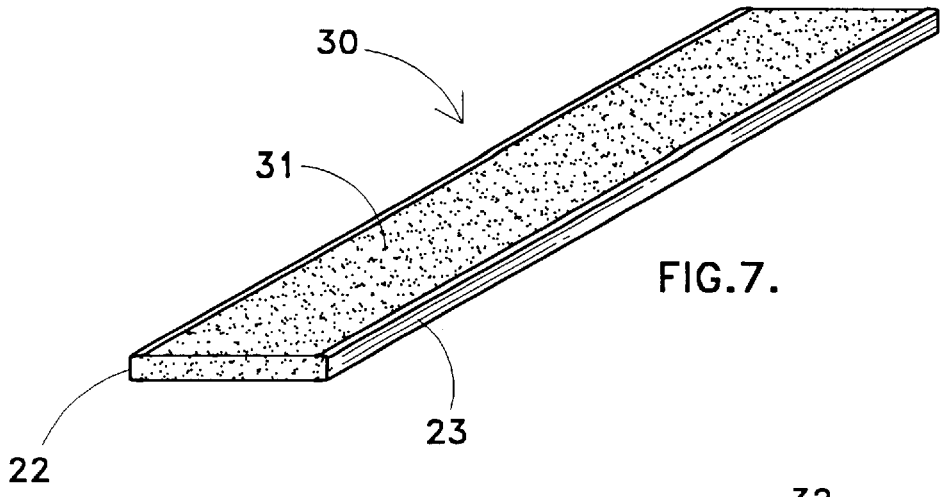
FIG. 7 is a view of the panel of FIG. 5 shown with its upper surface in a generally horizontal configuration.
Figure 8:
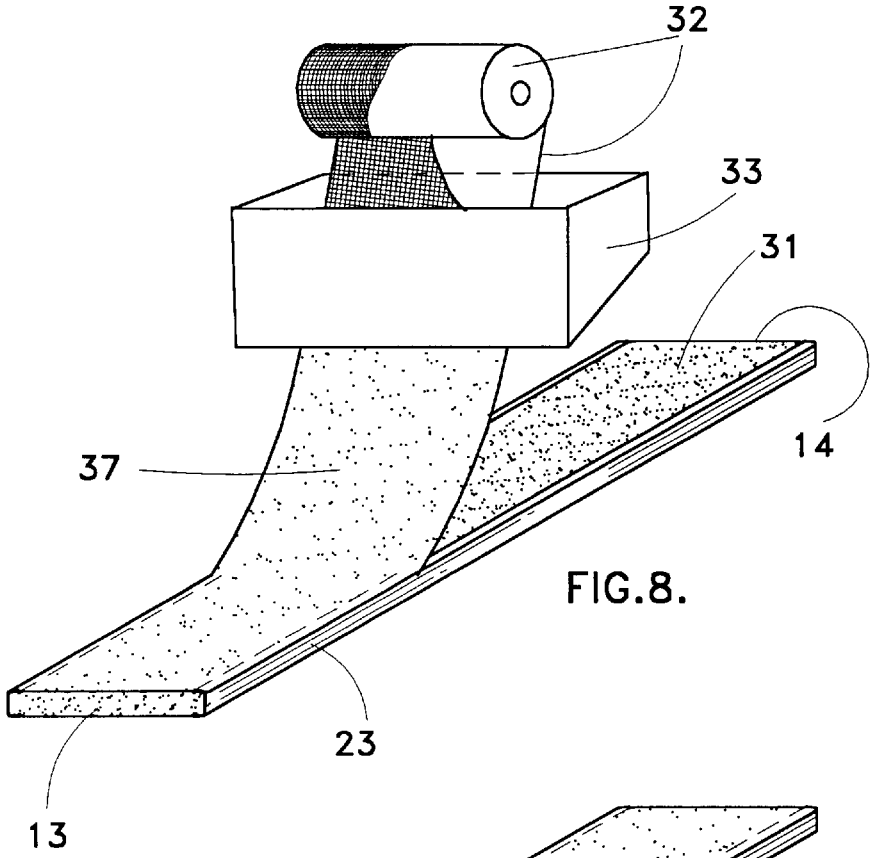
FIG. 8 is a perspective view of the panel of FIG. 7 in the process of being coated with a fiberglass mesh reinforced cementitious material.
Figure 9:
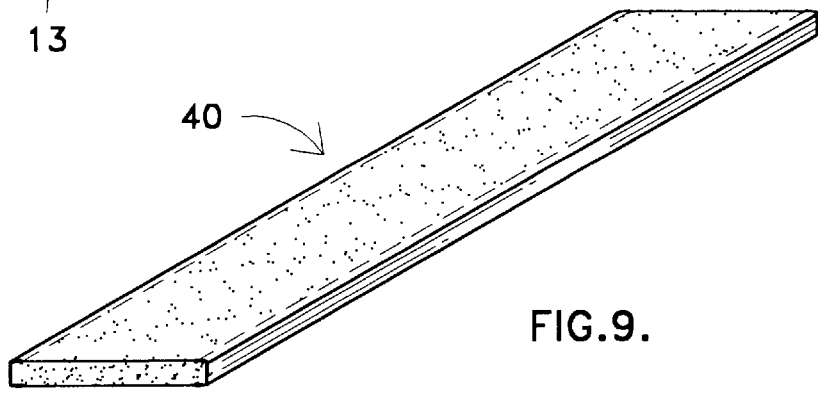
FIG. 9 is a perspective view of the panel of FIG. 7 with a coating of mesh reinforced cementitious material.
Figure 13:
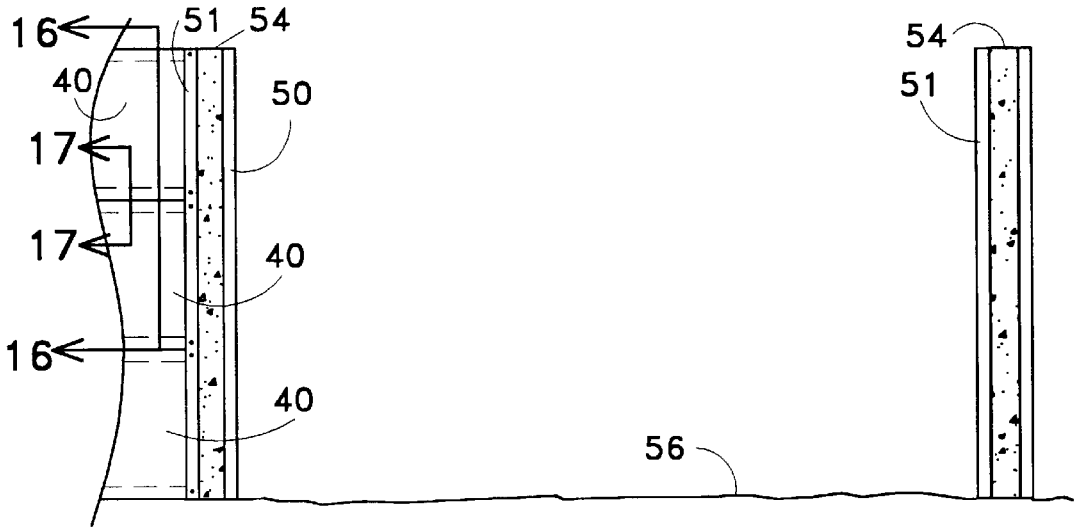
FIG. 13 is a front view of a fence under construction showing portions of three panels of FIG. 9 and a pair of fence posts.

The next step in forming a panel capable of constructing a strong and durable wall or fence is shown in FIGS. 8 and 9. The assembled uncoated panel 30 is shown in FIG. 7 with its upper surface 31 in a generally horizontal configuration. In FIG. 8 a roll of reinforcing mesh is shown supported above a container 33 which contains a cementitious material of the type typically referred to as "dry bond." This material is reinforced with an acrylic polymer so that it is exceptionally strong and able to withstand cracking. The reinforced mesh 32 is pulled through the moistened dry bond 34 (shown best in FIG. 10). As the open mesh 32 passes through the cementitious material 34, it is soaked with the cementitious material. The mesh exits container 33 through a slit 35 shown best in FIG. 11. This slit 35 is formed in a metal bar or between a pair of bars which may be adjusted and squeezes out any additional cementitious material 34 to provide a cement laden mesh 37. This carries the coating and reinforcement materials onto the upper surface 31 of assembled uncoated panel 30. When the cement laden mesh 37 reaches the end 14 it is cut and a new panel may then be coated.

A coated panel 40 is shown in FIG. 9 and this panel has a reinforced cementitious coating on both sides thereof. Needless to say, after one side of the panel is coated as shown in FIG. 8 it is permitted to cure. It is then turned over and the second side is coated. The finished coated panel is indicated by reference character 40. During the coating process, as shown best in FIG. 12, it is advantageous for the container 33 filled with cementitious material 34 and the roll of reinforced mesh to be rolled along a pair of tracks 41 on a frame 42. The panel 30 being coated rests on a table 43 which is supported on the ground. Table 43 is preferably equipped with a vibrator 44. Vibrator 44 is briefly energized after the cement laden mesh has completely covered the upper surface 31 of panel 30. This greatly smooths the cementitious material and removes any air or imperfections and drives this material into the open cells of the foam surface. The outer surface of the thus smoothed cementitious material may then be slightly roughened, if desired, to facilitate the later coating with stucco. This may be done with a broom or other object after the vibration step. In addition one or more additional layers of open mesh and cementitious material may further be added over the first layer for additional strength. Three layers on each side make an exceptionally strong panel.

The method of building a fence or wall is shown best in FIGS. 13 through 19. Preferably cement posts made according to applicant's co-pending application, Ser. No. 08/982,061 filed Dec. 1, 1997, are placed at intervals so that there is no more than a 10' space between adjacent posts. As shown best in FIG. 19, a pair of channels 50 and 51 are held against faces 52 and 53 of cement post 54. The channels 50 and 51 are held against the faces by a nut and bolt indicated generally by reference character 55. These channels are preferably made from galvanized iron of 25 gauge, similar to channels 22 and 23.

Figure 14:
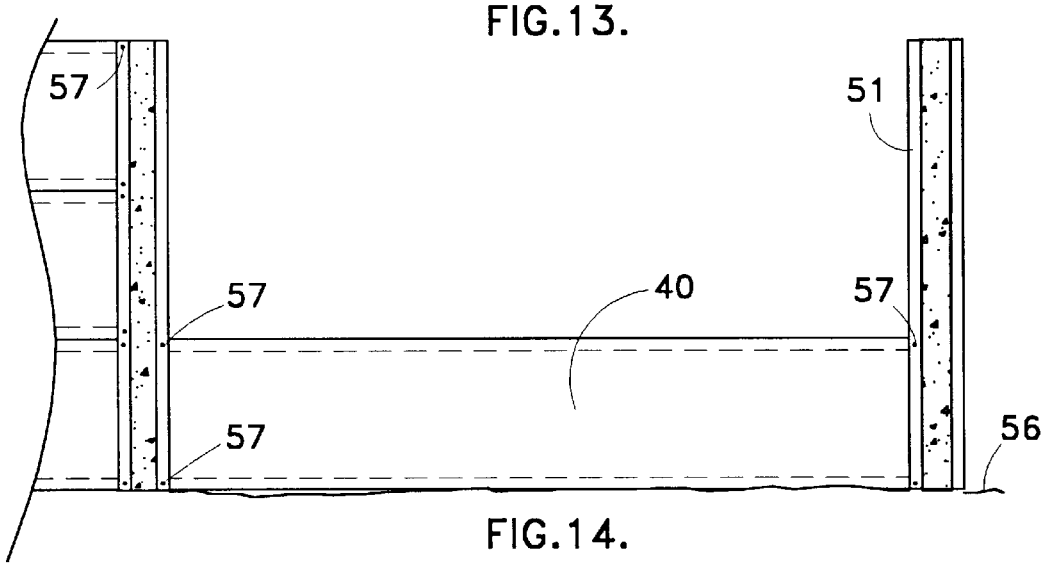
FIG. 14 is a front view analogous to FIG. 13, except that one panel has been placed between the two adjacent posts.
Figure 15:
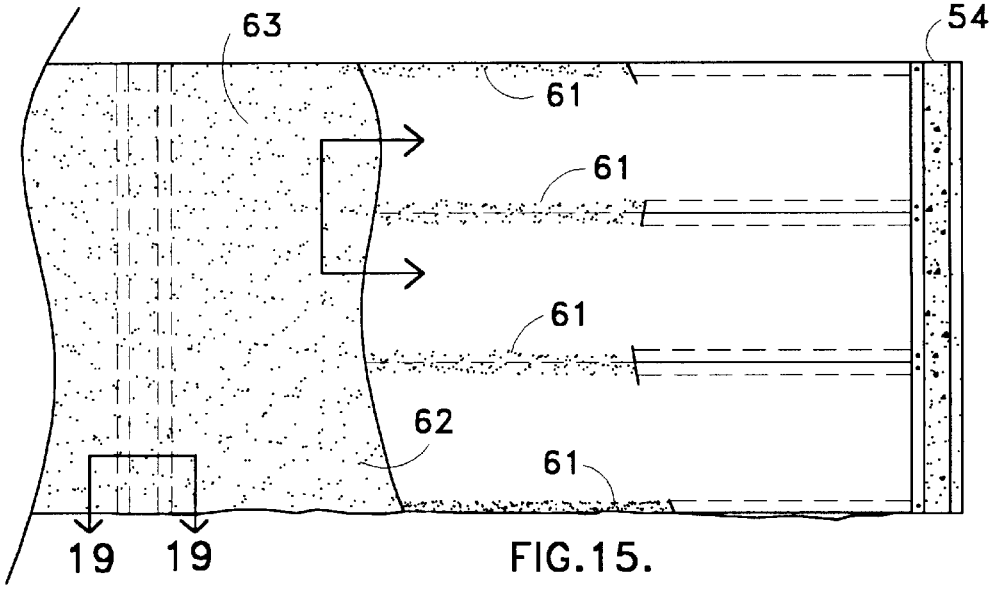
FIG. 15 is a front view analogous to FIG. 14 showing three of the panels of FIG. 9 at three states, one being ungrouted, one being grouted, and one being grouted and covered with stucco.
Figure 17:
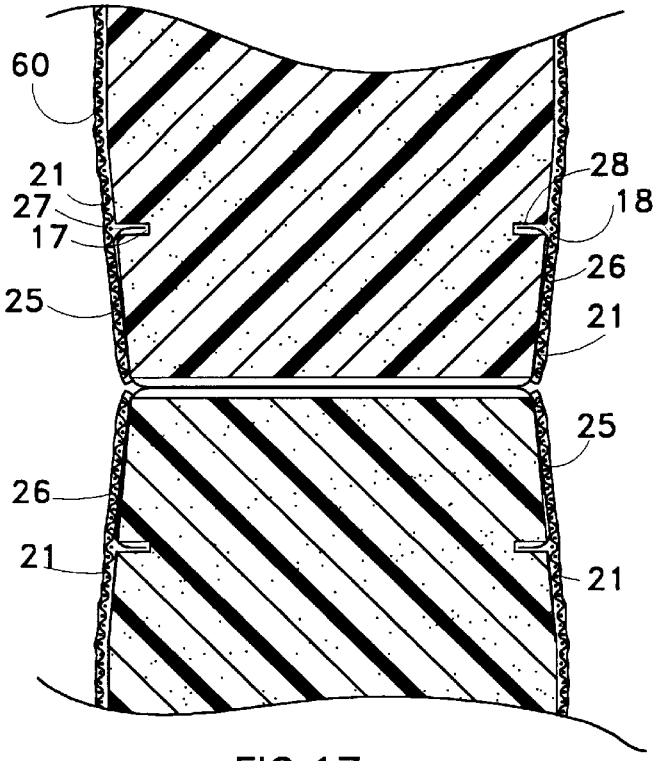
FIG. 17 is a cross-sectional view taken along line 17—17 of FIG. 13.
Figure 18:
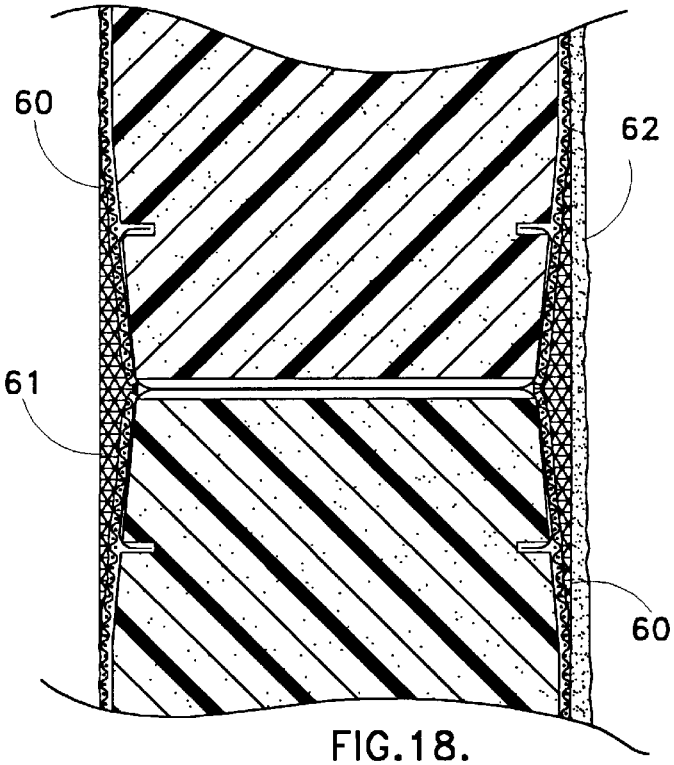
FIG. 18 is a cross-sectional view taken along line 18—18 of FIG. 15.

Returning to FIG. 15, three coated panels 40 have been inserted between adjacent posts, only one of which is shown in FIG. 14, and slid into channel 51. It is often preferable to space the posts slightly less than 10' and to cut the panels to length before inserting. The panels may be easily cut with a carborundum blade. Next, a new coated panel is slid downwardly from the top of channels 50 and 51 until it touches ground 56. Once the panels are leveled, they are preferably screwed with screwed with sheet metal screws through the vertical channels attached to the post, such as channel 50, into the horizontal channels attached to the panels, such as channel 22. In the case of a 6' high fence, three 2' high panels are put in place as shown in FIG. 15. As the panels are initially placed in channels 50 and 51, they abut together as shown in FIG. 17. Because of the bevel 21 a shallow depression or trough is formed which is shown unfilled in FIG. 17 and filled in FIG. 18. The formerly cement laden mesh 37 has cured into a reinforced cement coating 60 which covers not only the faces of the foam, but also covers the sides 25 and 26 of the reinforcing channels, such as channels 22 and 23.

Figure 16:
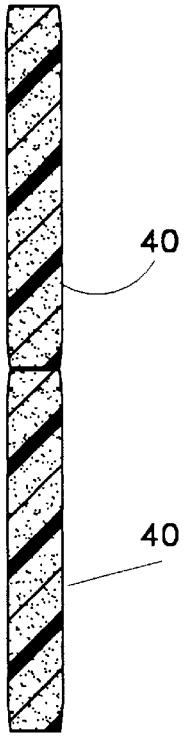
FIG. 16 is a cross-sectional view taken along line 16—16 of FIG. 13.

Two adjacent channels are shown in FIG. 16 in a typical proportion of height and width. Even when the panels are coated with the reinforced cementitious material they are easy to lift and slide into the channels attached to the post.

Figure 19:
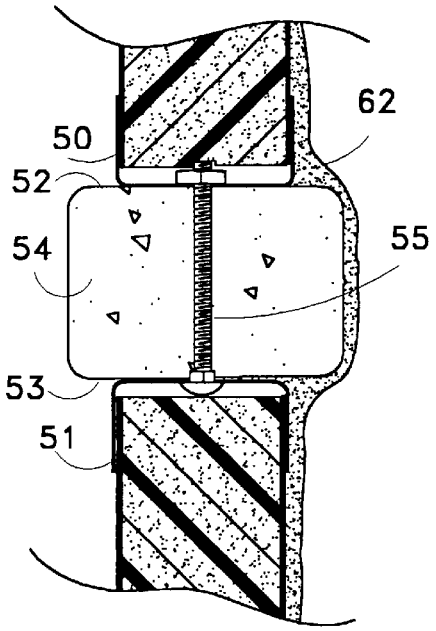
FIG. 19 is a cross-sectional view taken along line 19—19 of FIG. 15.

Next, a grouting material 61 is placed in the shallow trough formed by bevels 21. Grouting material 61 is preferably reinforced either by a reinforcing tape or by reinforcing fibers in the grouting material. This is easily leveled with a putty knife to form a flat surface. Lastly, as shown in the righthand portion of FIG. 18, a layer of stucco 62 is placed over the faces of the panels. Stucco 62 is preferably also placed over the cement post 54 as shown in FIG. 19. The finished fence is shown in the lefthand portion of FIG. 15 and indicated generally by reference character 63. The fence or wall is economically constructed because it can be done quickly by relatively unskilled laborers without the necessity of building a footing. Because the fence is constructed of very lightweight materials, it can withstand a substantial earthquake shock. If it happens to be struck with a car, the fence can be readily repaired.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A panel for use in the construction of walls comprising:

a generally rectangular panel having a top, a bottom, a first end, a second end, a first face and a second face, said panel having a height and a length with said length substantially longer than its height, said panel being fabricated from a polymeric foam;

an upper pair of grooves formed in the first and second faces of said panel parallel to and near said top;

a lower pair of grooves in the first and second faces of said panel parallel to and near said bottom; and a pair of generally C-shaped reinforcing channels, each channel having a face adjacent one of said top and bottom, one of said channels being adjacent said top of said panel and the other of said channels being adjacent said bottom of said panel, a pair of generally flat sides on each channel extending from the face adjacent said first and second faces, and a pair of inwardly depending portions on each of said channels at ends of each generally flat side, said inwardly depending portions positioned in said grooves of said panel and said channels being fabricated from a rigid material, the panel and channels forming a rigid assembly and wherein said first and second faces of said panel are beveled longitudinally to form beveled faces along said panel at the top and bottom of said panel and said beveled faces extend past said grooves.

2. The panel of claim 1 wherein said beveled faces are at an angle of from about two to about ten degrees with respect to said first and second faces.

3. The panel of claim 2 wherein said bevel is at an angle of about five degrees.

4. The panel of claim 1 further including at least one reinforced coating on the first and second faces.

5. The panel of claim 4 wherein said reinforced coating extends to about the top, the bottom, the first end and the second end.

6. The panel of claim 4 wherein said reinforced coating includes a mesh made of fibers.

7. The panel of claim 4 wherein said at least one reinforced coating comprises a cement based coating with polymer.

8. The panel of claim 1 wherein said pair of generally C-shaped reinforcing channels are fabricated from a ferrous metal.

9. The panel of claim 8 wherein said channels are fabricated from galvanized sheet metal.

10. The panel of claim 9 wherein said galvanized sheet metal is about 25 gauge thick.

11. A process for building a hard and flat surfaced paneled fence utilizing a plurality of vertical adjacent fence posts, a plurality of elongated rectangular panels, each panel having a reinforced top and bottom and a beveled portion along at least one of said top and bottom, a first end and a second end and a length, and said fence posts having spaces between the adjacent posts about equal to said length, said fence having a fence height and each of said panels having a height which is about an even fraction of the height of the fence, said process comprising:

affixing a first end of the first of said panels to a first of said posts and affixing the second end of said first of said panels to a second of said posts which is adjacent said first post, said first panel having a beveled portion facing upwardly;

affixing a first end of the second panel to said first post and affixing the second end of said second panel to said second post, said second panel having a beveled portion facing downwardly and adjacent said beveled portion of said second panel adjacent said beveled portion of said first panel thereby forming a shallow trough below a plane of a first face of said first panel and a first face of said second panel; and filling said shallow trough with a grouting material so that said grouting material has an outer face which is aligned with the first faces of said first and second panels thereby forming a hard and flat face made up of said first and second panels.

12. The process for building the smooth-surfaced paneled fence of claim 11 wherein said affixing steps further comprise sliding one of said panels into a pair of opposing channels held by the first and second posts.

13. The process for building the smooth-surfaced paneled fence of claim 11 further including the step of covering said panels and posts with stucco.

* * * * *